United States Patent [19]

Schroeder et al.

[11] Patent Number: 4,664,058

[45] Date of Patent: May 12, 1987

[54] COATING ROLL SURFACE CONFIGURATION FOR APPLYING LIQUID STERILANT TO A MOVING WEB

[75] Inventors: Joseph G. Schroeder, Bay Village, Ohio; Donald E. Keeler, Vernon, N.J.

[73] Assignee: International Paper Company, New York, N.Y.

[21] Appl. No.: 791,270

[22] Filed: Oct. 25, 1985

[51] Int. Cl.[4] ..... B05C 1/08

[52] U.S. Cl. ..... 118/249; 118/694; 118/DIG. 15; 29/121.4; 422/292

[58] Field of Search ..... 118/212, DIG. 15, 249, 118/694; 422/292; 29/121.4, 132

[56] References Cited

U.S. PATENT DOCUMENTS

| | | | |
|---|---|---|---|
| 2,123,313 | 7/1938 | Parks | 91/51 |
| 2,199,228 | 4/1940 | Obenshain et al. | 91/50 |
| 2,294,513 | 9/1942 | Pearson | 118/DIG. 15 |
| 2,309,585 | 1/1943 | Haddock | 91/12.7 |
| 2,530,282 | 11/1950 | Brodie et al. | 101/350 |
| 2,606,520 | 8/1952 | Hoel | 118/249 |
| 2,741,215 | 4/1956 | Cady et al. | 118/212 X |
| 2,781,278 | 2/1957 | Harmon | 118/212 X |
| 2,915,038 | 12/1959 | Wallenberg | 118/249 |
| 2,961,336 | 11/1960 | Uhleen | 117/49 |
| 3,056,164 | 10/1962 | Reichel et al. | 18/15 |
| 3,150,002 | 9/1964 | Justus | 118/249 |
| 3,405,884 | 10/1968 | Patterson, Jr. | 242/76 |
| 3,561,401 | 2/1971 | Ford et al. | 118/249 |
| 3,605,682 | 9/1971 | Groce et al. | 118/7 |
| 3,693,585 | 9/1972 | Reeve et al. | 118/104 |
| 3,762,365 | 10/1973 | Herzog | 118/212 |
| 3,795,441 | 3/1974 | Hoffman et al. | 355/3 R |
| 4,016,811 | 4/1977 | Zavodny | 101/148 |
| 4,132,166 | 1/1979 | Bugnone | 101/247 |
| 4,269,140 | 5/1981 | Burns et al. | 118/665 |
| 4,270,483 | 6/1981 | Butler et al. | 118/46 |
| 4,497,274 | 2/1985 | Focke | 118/221 |
| 4,497,577 | 2/1985 | Sato et al. | 356/336 |

*Primary Examiner*—John P. McIntosh

*Attorney, Agent, or Firm*—Walt Thomas Zielinski; Richard J. Ancel

[57] ABSTRACT

An apparatus for coating a plastics coated paperboard web with a sterilizing liquid such as hydrogen peroxide, the web adapted to be folded and cut to form aseptic packages for filling with foodstuffs such as fruit juices and milk. The apparatus includes a pair of rolls between which the web is moved and is coated. The lower (applicator) roll of the pair is provided with continuous helical grooves and is partially immersed in a bath of sterilizing liquid. The configuration of the grooved surface of the applicator roll has been found to be critical in meeting coating standards in the field of aseptic packaging. The grooves make a pitch angle of from 5° to 12° with the longitudinal axis of the applicator roll, with a preferred angle of 9°. Either single grooves or crossed grooves may be used, with the land area of this roll being from 60 to 80%. The applicator roll is manufactured from stainless steel (#316). The silicon elastomer of 60 Durometer hardness is bonded to its diameter, the outer cylindrical surface carrying the configuration or pattern of grooves.

16 Claims, 6 Drawing Figures

COATING ROLL SURFACE CONFIGURATION FOR APPLYING LIQUID STERILANT TO A MOVING WEB

BACKGROUND OF THE INVENTION

This invention relates to an apparatus for coating or applying a sterilizing agent such as hydrogen peroxide to a web, usually a continuous web, the invention exhibiting particular utility in the field of aseptic packaging.

Aseptic packaging may be defined as the packaging of foodstuffs which have been sterilized such as milk and fruit juices as well as solid foods, in containers which are themselves sterile. The sterility of the completed container helps insure that spoilage of the packaged foodstuff will not occur, or will occur only after a long period of time, even in the absence of refrigeration. Typically, an aseptic package is formed by passing a continuous web of a plastics coated paperboard material through a forming apparatus, the forming apparatus folding the web into the form of a container. The container is then filled with the foodstuff, cut from the remainder of the web and sealed. In addition to the requirement that this apparatus operate in a sterile atmosphere (sometimes termed sterile ambient) it is necessary that the web be coated with a sterilizing agent, such as hydrogen peroxide, on at least that surface which will define the interior surface of the containers. Such a sterilizing agent is necessary because, from the time of its manufacture to the time of its ultimate use in making aseptic packages, the web may be exposed to a variety of contaminating agents or substances. Accordingly, it is desirable that the web be sterilized immediately prior to its formation into packages, U.S. Pat. No. 3,947,249 issued on its face to Egger hereby incorporated by reference, illustrates an apparatus for packaging under sterile conditions.

The type of sterilizing agent and the amount of it applied to the web have been more or less codified into industry standards in the field of aseptic packaging. These standards have been set, in the United States, by the Food and Drug Administration (FDA). For example, for a one quarter liter aseptic package, industry standards require that a minimum of 89 to a maximum of 133 ml. of hydrogen peroxide be coated on one web surface per 1,000 packages.

The art of coating a web embraces a great variety of coating apparatus, including the use of coating rollers between which a material to be coated, such as a web of indefinite length, passes. Typically, the rollers are formed in pairs and rotate on horizontal axes, one roller being above the other with the lower (application) roller being partially immersed in a bath or vat of a coating material. The present invention employs rollers of this type, with the lower roller being partially immersed in a bath of hydrogen peroxide.

In addition to the FDA regulations regarding the amounts of sterilizing agent applied, it is necessary that the coating be uniformly applied. While simple in concept, the practical application of such rolls for coating a web of plastics material for aseptic packaging reveals that there exists parameters associated with the coating rollers which must be observed if the desired uniformity of the coating is to be obtained.

In the coating of the web material with hydrogen peroxide, it is usual that different stock rolls of the web material will contain different amounts of moisture in the paperboard, for example. This, together with changes in ambient temperature and humidity, yields the undesirable result that upon changing web stock rolls (as they become used up), the nip pressure setting which yielded a desired peroxide coating rate for the previous (used up) web roll will yield a sufficient peroxide coating rate for the new roll of web material. Accordingly it is necessary, in some cases, to reset the nip pressure with each new stock web roll.

With a smooth-surfaced applicator roll or with an applicator roll with discrete depressions on its surface, it was not possible, to obtain the desired FDA coating rates or minimum and maximum range no matter what the nip pressure was.

SUMMARY OF THE INVENTION

In accordance with the practice of this invention, it has been found that for roller coating a web of approximately 11.875 inches (30.2 cm) in width, (the web width for producing a one-quarter liter container) a specific roll surface configuration has been found critical in meeting FDA requirements. More specifically, tests and experimentation have demonstrated that, firstly, the applicator roll (the one partially immersed in the bath of sterilizing liquid) must be provided with helical grooves and, in combination with this requirement, the helical grooves must be of a certain pitch and must be of such a width as to leave a land area on the applicator roll of from 60 to 80%. The term land area refers to the cylindrical surface of the applicator roll which remains after the helical grooving has been cut into it. In other words, the land area is the remaining cylindrical surface which is not the helical groove surface. Tests and experimentation have demonstrated that unless the helical grooves make an angle of between 5 to 12 degrees with respect to the longitudinal axis of the applicator roll (preferably 9°), the uniformity of coating of the hydrogen peroxide to the web is unsatisfactory. Further according to the practice of this invention, the applicator roll is fashioned from a steel cylinder, with the cylindrical surface of this cylinder being coated with a silicone rubber of approximately 60 Durometer hardness. Silicone rubber has been found capable of withstanding the hydrogen peroxide, a feature not exhibited by all elastomers.

In order that the helical grooves in the silicone rubber coating of the applicator roll be located on the rubber coating with the necessary degree of accuracy, i.e., uniformity of pitch, width and depth, it has been found convenient to form them on the silicone rubber surface by laser engraving or laser etching. The construction of a silicone rubber coated applicator roll as well as laser etching or engraving of the helical grooves form no part of this invention. Such devices and techniques are known in this art, and may be seen for example by reference to the following U.S. Pat. Nos.: 4,352,973 issued to Chase (laser engraving), 4,050,886 issued to Moser and 4,074,001 issued to Imal et al (silicone rubber coated cylinder). Such rolls are obtainable from, for example, Luminite Products Corp. of Salamanca, N.Y.

By configuring the applicator roll in the manner described, the FDA coating rate requirements, for a one-quarter liter container, can be met, and, further, variation in nip pressure will yield the desired variation in coating rate usually required with different web rolls.

DETAILED DESCRIPTION OF THE INVENTION

Figure 1:
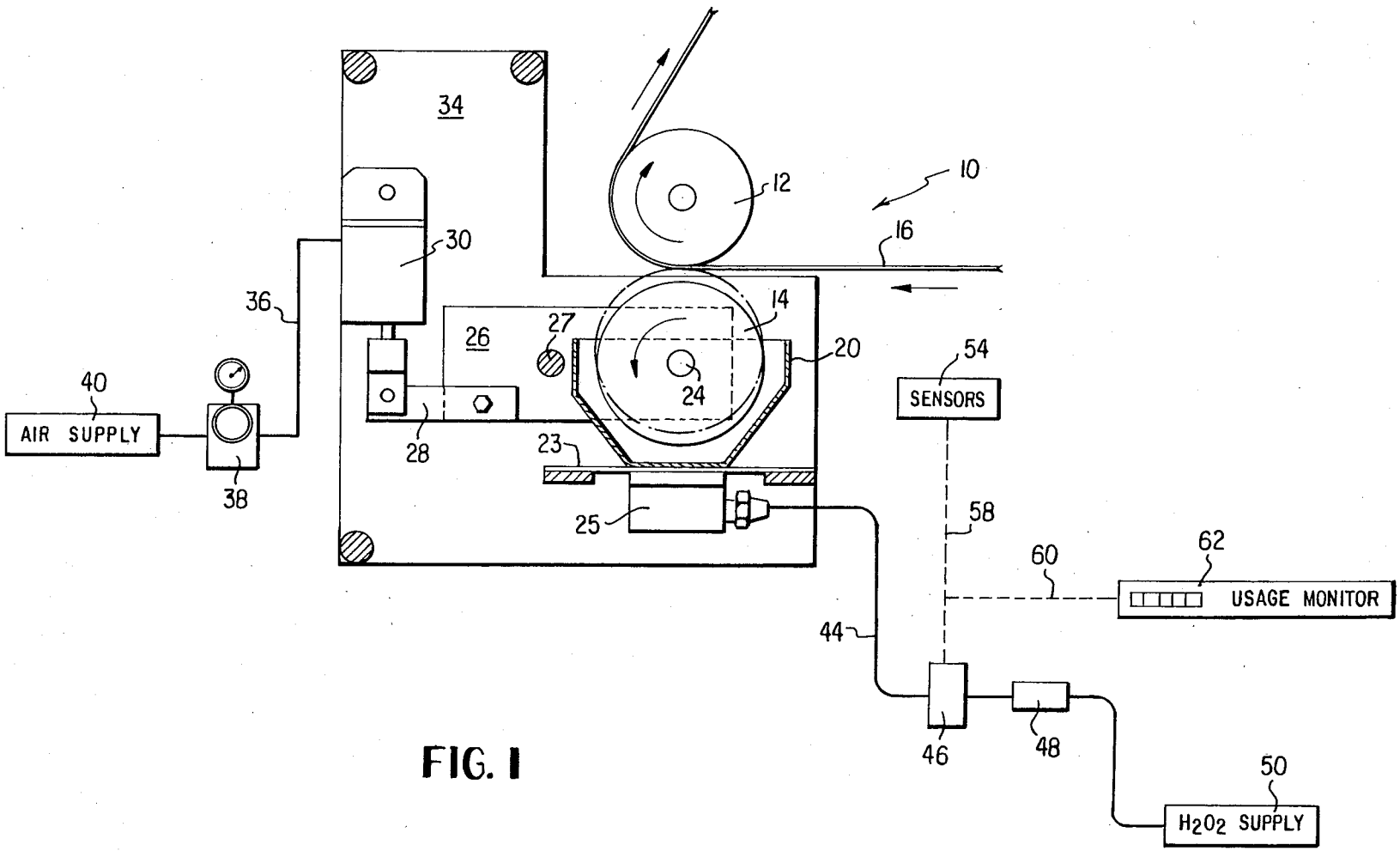
FIG. 1 is a partially schematic cross-sectional view illustrating the rolls of this invention in combination with an apparatus for coating a sterilizing liquid on a web.

Referring now to FIG. 1 of the drawings, the numeral 10 denotes a portion of an apparatus for making aseptic packages from flexible webs, usually from webs of indefinite length, the webs being formed from paperboard coated with polyethylene, for example, although it will be understood that the exact composition of the web itself forms no part of this invention. The numeral 12 denotes an upper back-up roll, usually formed of steel tubing. The roll is suitably positioned in end bearings for rotation about a horizontal axis. The numeral 14 denotes a lower or applicator roll, being the second of the sterilizing agent roll pair for coating the web. The numeral 16 denotes a portion of the web, which is shown as passing from a web supply roll (not illustrated) through the nip of roll pair 12, 14 and thence upwardly from roll 12 to a package forming and filling apparatus (not illustrated).

The numeral 20 denotes a reservoir tank of the indicated cross-section and generally rectangular in top plan view. The reservoir tank is adapted to carry a controlled volume of sterilizing liquid, such as hydrogen peroxide, with the lower portion of applicator roll 14 being immersed within the sterilizing liquid. The sterilizing liquid is fed into reservoir tank 20 supported by a bracket 23 and by means of inlet fitting 25 which is in fluid communication with the interior of the reservoir tank.

The numeral 24 denotes one of a pair of pintles at the ends of applicator roll 14 for rotationally supporting it, with one of each pintle being received in the ends of pivoted support bars 26, the latter pivoted at 27 carrying an extension 28 whose free end is linked to a piston of a piston-cylinder denoted by the numeral 30, the latter being mounted on end plate 34 of apparatus 10. The numeral 36 denotes an air supply line to the interior of piston-cylinder 30, the line from air pressure regulator 38, the latter receiving air from a compressed air source denoted schematically by the numeral 40.

The numeral 44 denotes a sterilizing liquid supply line feeding the fitting 25, with supply line 44 being fed from a reservoir pump denoted schematically by the numeral 46, the latter being fed through filter 48, the latter being coupled to a supply 50, schematically designated, of a sterilizing liquid such as hydrogen peroxide. The numeral 54 denotes schematically two sensors which measure the high and low levels of liquid within reservoir tank 20. The numeral 58 schematically designates a feedback circuit between sensors 54 and pump 46, with schematically indicated line 60 coupled to a usage monitor, typically an electronic usage monitor, schematically designated by the numeral 62. The construction of sensors 54 and the feedback circuit form no part of this invention.

The general mode of operation of the apparatus thus described is as follows. Web 16, passing in the indicated direction through the nip of rolls 12, 14 from a web roll causes rotation of the rolls in the indicated direction. Applicator roll 14 picks up and carries on its surface a portion of the sterilizing liquid in reservoir tank 20, with the result that the underside of web 16 becomes uniformly coated with the sterilizing liquid. Thereafter, the web 16, now with one surface coated, passes to the package forming and filling apparatus, wherein the coated surface of the web will be the interior surface of the aseptic packages. The sensors 54, usage monitor 62 and pump 46 cooperate to maintain a predetermined level of liquid within reservoir tank 20. The nip pressure (typically expressed in pounds per lineal inch) exerted by rolls 12, 14 on web 16 is controlled by pressure regulator 38 which maintains a desired pressure within the two cylinders 30 to thereby pivot plates 26 about pivots 27, thereby effecting any desired distance between the axes of rotation of rolls 12, 14 by varying the position of roll 14 relative to the fixed position of roll 12, the latter designated by the dashed circle adjacent the solid circle denoting roll 14. This variation of distance varies the nip pressure on the web. In general, the apparatus thus far described is conventional.

The remaining description will now treat of the specific advance in this art over prior coating roll surface configurations.

Figure 2:
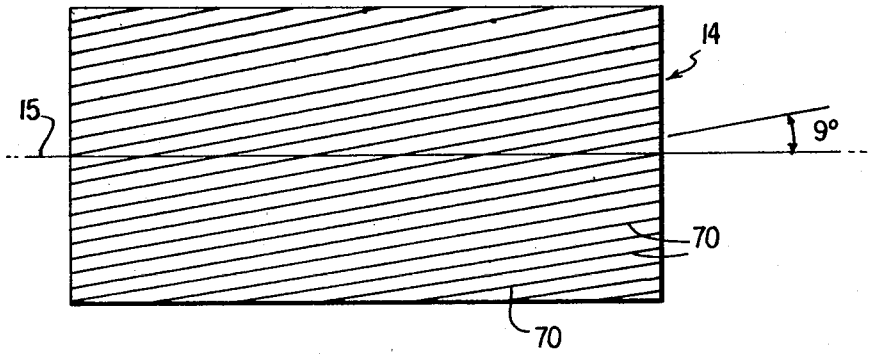
FIG. 2 is a plan view of the applicator roll surface of this invention carrying a single groove, the view showing the orientation of grooves on the surface.
Figure 3:
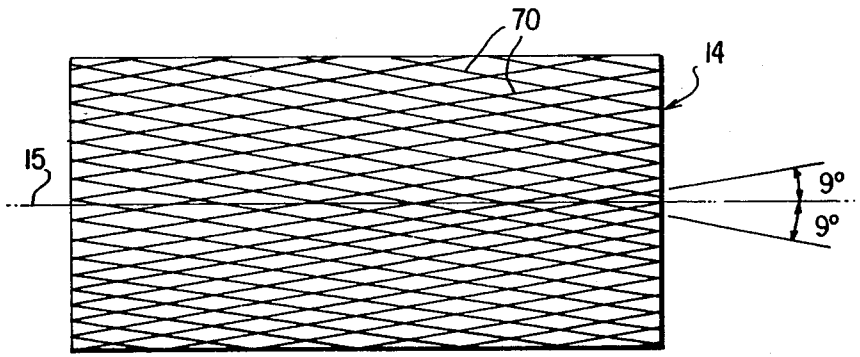
FIG. 3 is a view similar to FIG. 2 and shows a cross groove surface configuration.

As indicated at FIGS. 2 and 3, the surface of applicator roll 14 is provided with a plurality of grooves 70, with a single groove configuration being illustrated at FIG. 2 and a cross-groove configuration being illustrated at FIG. 3. FIGS. 2 and 3 show the roll surfaces as though they had been peeled off of the applicator roll. The angle which groove 70 makes with the longitudinal axis 15 of roll 14 is from 5° to 12°, with a preferred angle being of about 9°. The width of grooves 70 is such that the land area is from to 60 to 80%. The groove 70 may be either right handed or left handed. As indicated at FIG. 3, grooves 70 may be crossed, i.e., one set of grooves, such as that shown at FIG. 2, intersecting a second set of grooves, with both sets of grooves being preferably at the same angle with respect to the longitudinal axis 15 of roll 14, but crossing each other. With the cross groove configuration of FIG. 3, the same limits of angle of the grooves are observed, namely, the grooves 70 are between 5° and 12° with respect to the longitudinal axis 15 of the roll with a land area of from 60 to 80%.

The single groove configuration of FIG. 2 will yield the required FDA coating application rates. However, the thickness of the coating will not be uniform over the width of the web, being thicker at one web edge than at the other web edge. It has been found that the cross-groove configuration of FIG. 3 will not only yield the required FDA coating application rates, but will produce a coating of the liquid sterilant (hydrogen peroxide for example) of uniform thickness over the web width. Thus FIG. 3 shows the preferred groove configuration.

Figure 6:
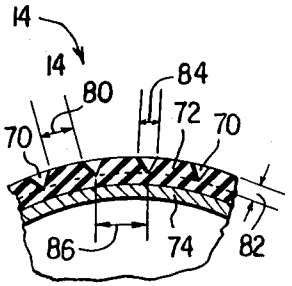
FIG. 6 is a cross-sectional view of the applicator taken along sections 6—6 of FIG. 4.
Figure 4:
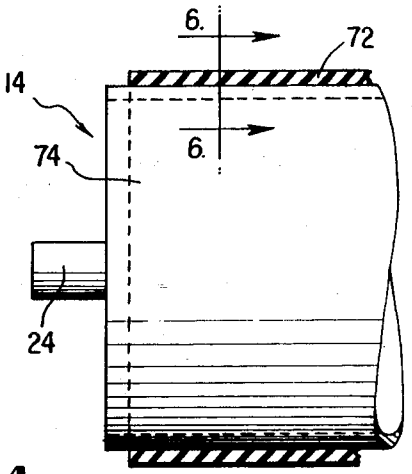
FIG. 4 is a partially broken view and shows the construction of the applicator roll.
Figure 5:
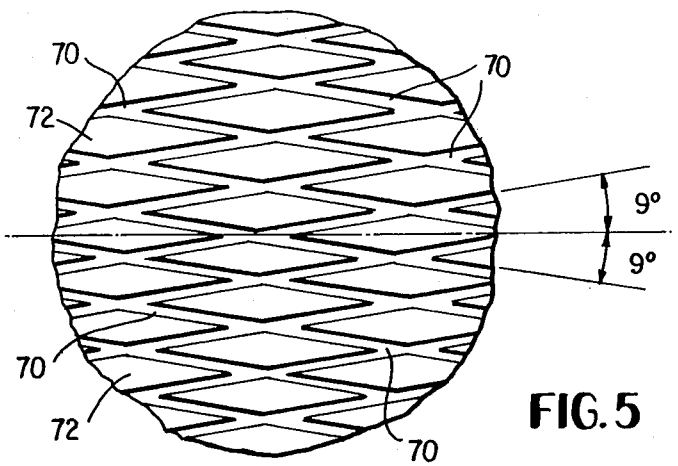
FIG. 5 is a magnified view of a portion of FIG. 4.

Referring now to FIGS. 4–7, a more detailed description will be offered of the construction of applicator roll 14 and grooves 70. As indicated at FIG. 4, roll 14 is defined by an outer coating 72 of an elastomer, preferably silicone rubber having a hardness of about 60 Durometer. Coating 72 is on the outer cylindrical surface of hollow steel cylinder 74. In the preferred embodiment, the land width 80 between grooves, as indicated at FIG. 6, is 0.026 inches. The depth 82 in any groove 70 is 0.004 inches and the width 84 of the grooves at the exterior surface of coating 72 is 0.002–0.003 inches. For a width of silicone rubber coating 72 of roller 14 of 11.25 inches, and with an outside diameter of 2.72 inches, the total number of either right or left hand helices (grooves 70) is 294. The preferred land area is 80%. The width of the grooves remains the same whether the configuration of FIG. 2 or that of FIG. 3 is employed. The distance between similar-handed grooves is greater in FIG. 3 than in FIG. 2 because every other groove is converted from a right hand to a left hand helix or vice versa. Thus the groove width and land area remain the same for both configurations, as does the total number of grooves.

It was found through extensive testing of various configurations (patterns) on the applicator roll, with each configuration being individually analyzed and defined, that any groove 70 must be continuous to thereby allow fluid to flow evenly over the width of roller. A series of individual cylindrical or square-shaped holes, for example, does not permit the desired application rate of between 133 to 89 ml/1000 packages with variation of nip pressure. Further, the grooves 70 must be helical. Straight continuous grooves alone will not provide the wide application range required (89 ml/1,000 pkg to 133 ml/1,000 pkg) unless the continuous grooves are placed on a helix angle (min. 5° to max. 12°). A 9° helix angle provides the best results. It was also found that the land percentage on roller surface must be held between 60% to 80%. Below 60% or above 80% takes application of the sterilant out of the specified tolerance range (min. 89 ml/1,000 pkg to max. 133 ml/1,000 pkg.). By the use of the grooves of this invention, the application rate of the hydrogen peroxide may be varied by variation of nip pressure to obtain the FDA mandated peroxide coating rate range.

For a one-quarter liter package, the following relationships were found between, the air pressure in piston-cylinder motor 30, nip pressure between rolls 12 and 14, forces on the rolls and $H_2O_2$ application rates, for the desired rolls.

TABLE I

| Spec. Limits (ml/1,000 pkgs) | Air Pressure (psi) | Roll Force (lbs) | Nip Force (lbs/1 in. inch at the nip) | Avg. Application Rates (ml/1,000 pkgs |
|---|---|---|---|---|
| Low - 89 | 60 | 66.27 | 5.890 | 96 |
| Mean - 113 | 40 | 44.18 | 3.927 | 111.5 |
| High - 133 | 20 | 22.09 | 1.963 | 134.6 |

The entry Air Pressure is given for the particular size piston-cylinder used. Clearly the relationship between air pressure in 30 and nip force or roll force will vary with the size of 30 and the fularum lengths on bars 26. The air pressure is thus not a significant parameter.

What is claimed is:

1. An apparatus for coating a moving web of bendable material, such as paperboard coated with a plastics material, with a sterilizing liquid, such as hydrogen peroxide, the apparatus including a pair of horizontally disposed rolls, one being above the other, the rolls being parallel and contiguous to each other to thereby form a nip between them, the upper roll of said pair being a back-up roll and the lower of said rolls being an applicator roll, a sterilizing liquid reservoir tank for holding sterilizing liquid, the applicator roll being positioned so that at least a portion of its surface extends into said reservoir tank, means for varying the distance between the rolls to thereby vary the nip between the rolls and hence the pressure exerted by the rolls on the web, the applicator roll having a first plurality of parallel, continuous helical grooves substantially covering its cylindrical surface, the helical grooves being at a pitch angle of from about 5° to about 12° relative to the longitudinal axis of the applicator roll.

2. The apparatus of claim 1 wherein the applicator is provided with a second plurality of parallel, continuous helical grooves, substantially covering the cylindrical surface of the applicator roll, the helical grooves being of an angle of from about 5° to about 12° relative to the longitudinal axis of the applicator roll, but measured in an opposite sense from the first plurality, the second plurality of helical grooves intersecting the first plurality of helical grooves.

3. The apparatus of claim 2 wherein the width of each of the grooves of the first and second pluralities of helical grooves is such that the land area of the applicator roll is from about 60 to 80%.

4. The apparatus of claim 3 wherein the applicator roll is defined by a metal cylinder whose cylindrical surface is covered with an elastomer.

5. The apparatus of claim 4 wherein the elastomer is silicone rubber.

6. The apparatus of claim 4 wherein the elastomer is silicone rubber of about 60 Durometer hardness.

7. The apparatus of claim 6 wherein the width of the applicator roll surface is about 11.25 inches (28.6 cm) and its outside diameter is about 2.72 inches (6.9 cm).

8. The apparatus of claim 1 wherein the width of each of the first plurality of helical grooves is such that the land area of the applicator roll is from about 60% to 80%.

9. The apparatus of claim 8 wherein the applicator roll is defined by a metal cylinder whose cylindrical surface is covered with an elastomer.

10. The apparatus of claim 9 wherein the elastomer is silicone rubber.

11. The apparatus of claim 9 wherein the elastomer is silicone rubber of about 60 Durometer hardness.

12. The apparatus of claim 11 wherein the width of the applicator roll surface is about 11.25 inches (28.6 cm) and its outside diameter is about 2.72 inches (6.9 cm).

13. A roll for applying a sterilizing liquid to a moving web, the roll being rigid and covered with silicone rubber, the roll having a first plurality of parallel, continuous helical grooves in its outer surface, the helical grooves being at a pitch angle of from 5° to 12° with respect to the longitudinal axis of the roll, the width of the grooves being such that the land area of the roll is from about 60 to 80%.

14. The roll of claim 13 wherein the outer surface of the roll is provided with a second plurality of helical grooves, also at a pitch angle of from 5° to 12° with respect to the longitudinal axis of the roll, but measured in an opposite sense from the first plurality, the second plurality of helical grooves intersecting the first plurality of helical grooves, the width of each of the grooves being such that the land area of the applicator roll is about 60 to 80%.

15. The roll of claim 13 wherein the pitch angle is about 9%.

16. The roll of claim 14 wherein the pitch angle is about 9%.

* * * * *